US009904236B2

(12) United States Patent
Sadamitsu et al.

(10) Patent No.: US 9,904,236 B2
(45) Date of Patent: Feb. 27, 2018

(54) IMAGE FORMING APPARATUS ACCOMODATING TONER COLLECTION CONTAINER

(71) Applicant: CANON KABUSHIKI KAISHA, Tokyo (JP)

(72) Inventors: Yushi Sadamitsu, Abiko (JP); Yutaka Koga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/490,229

(22) Filed: Sep. 18, 2014

(65) Prior Publication Data

US 2015/0078796 A1 Mar. 19, 2015

(30) Foreign Application Priority Data

Sep. 19, 2013 (JP) ..... 2013-193728

(51) Int. Cl.
*G03G 21/12* (2006.01)

(52) U.S. Cl.
CPC ..... *G03G 21/12* (2013.01); *G03G 2215/0129* (2013.01)

(58) Field of Classification Search
CPC ..... G03G 21/12
USPC ..... 399/360, 120, 124; 312/270.3; 355/298
See application file for complete search history.

(56) References Cited

U.S. PATENT DOCUMENTS

| | | | | |
|---|---|---|---|---|
| 5,260,755 | A * | 11/1993 | Imaizumi | G03G 21/12 399/35 |
| 5,581,342 | A * | 12/1996 | Yamauchi | 399/123 |
| 7,356,301 | B2 | 4/2008 | Onodera | |
| 7,555,255 | B2 | 6/2009 | Onodera | |
| 7,778,568 | B2 | 8/2010 | Sakashita et al. | |
| 8,195,079 | B2 * | 6/2012 | Tanaka et al. | 399/360 |
| 2007/0292179 | A1 * | 12/2007 | Kudo | 399/358 |
| 2007/0297840 | A1 * | 12/2007 | Onodera | G03G 21/12 399/358 |
| 2008/0131149 | A1 * | 6/2008 | Onodera | G03G 21/12 399/35 |

(Continued)

FOREIGN PATENT DOCUMENTS

| | | |
|---|---|---|
| JP | 8-54811 A | 2/1996 |
| JP | 10-171196 A | 6/1998 |

(Continued)

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

An image forming apparatus includes a collection container for collecting toner discharged from an image forming station, the collection container being movable between a mount position in which the collection container is mounted in the apparatus and a removable position in which the collection container is removable from the apparatus; and a door provided on the apparatus to permit access into the apparatus. A track of the collection container when the collection container is moved from the mount position to the removable position overlaps a track of the door when the door is opened and closed, and when the door is in its open position, the collection container is incapable of being removed from the main assembly, and when the door is in its closed position, the collection container is removable from the main assembly.

6 Claims, 7 Drawing Sheets

(56) References Cited

U.S. PATENT DOCUMENTS

| | | | | |
|---|---|---|---|---|
| 2010/0239341 | A1 | 9/2010 | Tanaka et al. | |
| 2013/0287412 | A1* | 10/2013 | Koga | 399/13 |
| 2015/0139712 | A1* | 5/2015 | Sadamitsu | G03G 21/105 399/358 |

FOREIGN PATENT DOCUMENTS

| | | | | |
|---|---|---|---|---|
| JP | 11-184193 | A | | 7/1999 |
| JP | 2004-198789 | A | | 7/2004 |
| JP | 2007101794 | A | * | 4/2007 |
| JP | 2007-310206 | A | | 11/2007 |
| JP | 2008-003294 | A | | 1/2008 |
| JP | 2010-224025 | A | | 10/2010 |

* cited by examiner (a)

(b)

IMAGE FORMING APPARATUS ACCOMODATING TONER COLLECTION CONTAINER

FIELD OF THE INVENTION AND RELATED ART

The present invention relates to an image forming apparatus which recovers residual toner in its image forming section, and cumulatively stores the recovered toner recovered in its recovery container, by conveying the recovered toner to the recovery container. More precisely, it relates to a structure for taking the recovery container out of a preset position in the casing of the image forming apparatus.

An image forming apparatus which forms a toner image in its image forming section and directly transfers the toner image onto a sheet of recording medium, or indirectly transfers the toner image by way of an intermediary transferring member, has been widely in use. This type of image forming apparatus is equipped with a container in which transfer residual toner, and the like, which are generated while a toner image is formed in the image forming section, is cumulatively stored. Hereafter, this container will be referred to simply as a "recovery container." The recovery container is installed in the casing of the image forming apparatus (Japanese Laid-open Patent Application 2008-3294).

As a recovery container in the casing of an image forming apparatus is filled up with recovered toner, and the like, it is replaced with a new and empty recovery container. In the case of the image forming apparatus disclosed in Japanese Laid-open Patent Application 2008-3294, its recovery container is placed in a preset positioned in the casing of the apparatus so that it can be easily removed from the casing of the image forming apparatus, from the outward side of the casing, and also, so that a replacement recovery container can be easily installed into the preset position. More concretely, the image forming apparatus is structured so that the recovery container can be pulled out of the casing of the apparatus, from the front side of the apparatus, to be replaced with a new and empty recovery container.

From the standpoint of reducing the frequency with which a recovery container needs to be replaced, the recovery container is desired to be as large as possible. However, a recovery container which is large in bottom area size and low in height is difficult to fill up in such a manner that toner evenly spreads across the entirety of the container as it falls into the container. Therefore, a recovery container is desired to be tall, and small in footprint.

However, equipping the image forming apparatus disclosed in Japanese Laid-open Patent Application 2008-3294, with a tall recovery container requires a larger space for the recovery container to be pulled out frontward, which in turn increases in size the casing of the image forming apparatus. Further, it reduces the apparatus in latitude in terms of the interior design of the casing. Moreover, it becomes impossible to provide the casing with an internal space into which one of the two subassemblies, of which a sheet conveyance passage for reversing a sheet of recording medium is made, can be retracted. Further, when an exposing device, a fixing device, etc., need to be moved out of the casing, they are to be moved in the direction perpendicular to the direction in which the recovery container is to be pulled out. In other words, it makes impossible to properly position an exposing device, a fixing device, etc., in the casing.

SUMMARY OF THE INVENTION

The primary object of the present invention is to provide an image forming apparatus, the casing of which is no larger than that of a conventional image forming apparatus, and yet, can provide an internal passage through which a large recovery container can be pulled out of the casing.

According to an aspect of the present invention, there is provided an image forming apparatus comprising a main assembly; an image forming station configured to form a toner image; a collection container configured to collect toner discharged from said image forming station, said collection container being movable between a mount position in which said collection container is mounted in said main assembly and a removable position in which said collection container is removable from said main assembly; and an openable member provided on said main assembly to permit access into the main assembly; wherein a track of said collection container at the time when said collection container is moved from the mount position to the removable position overlaps a track of said openable member at the time when said openable member is opened and closed, and wherein when said openable member is in the opening position, said collection container is incapable of being removed from said main assembly, and when said openable member is in the closing position, said collection container is removable from said main assembly.

Further features of the present invention will become apparent from the following description of exemplary embodiments with reference to the attached drawings.

DESCRIPTION OF THE PREFERRED EMBODIMENTS

Hereinafter, embodiments of the present invention are described in detail with reference to the appended drawings.

Embodiment 1

Figure 1:
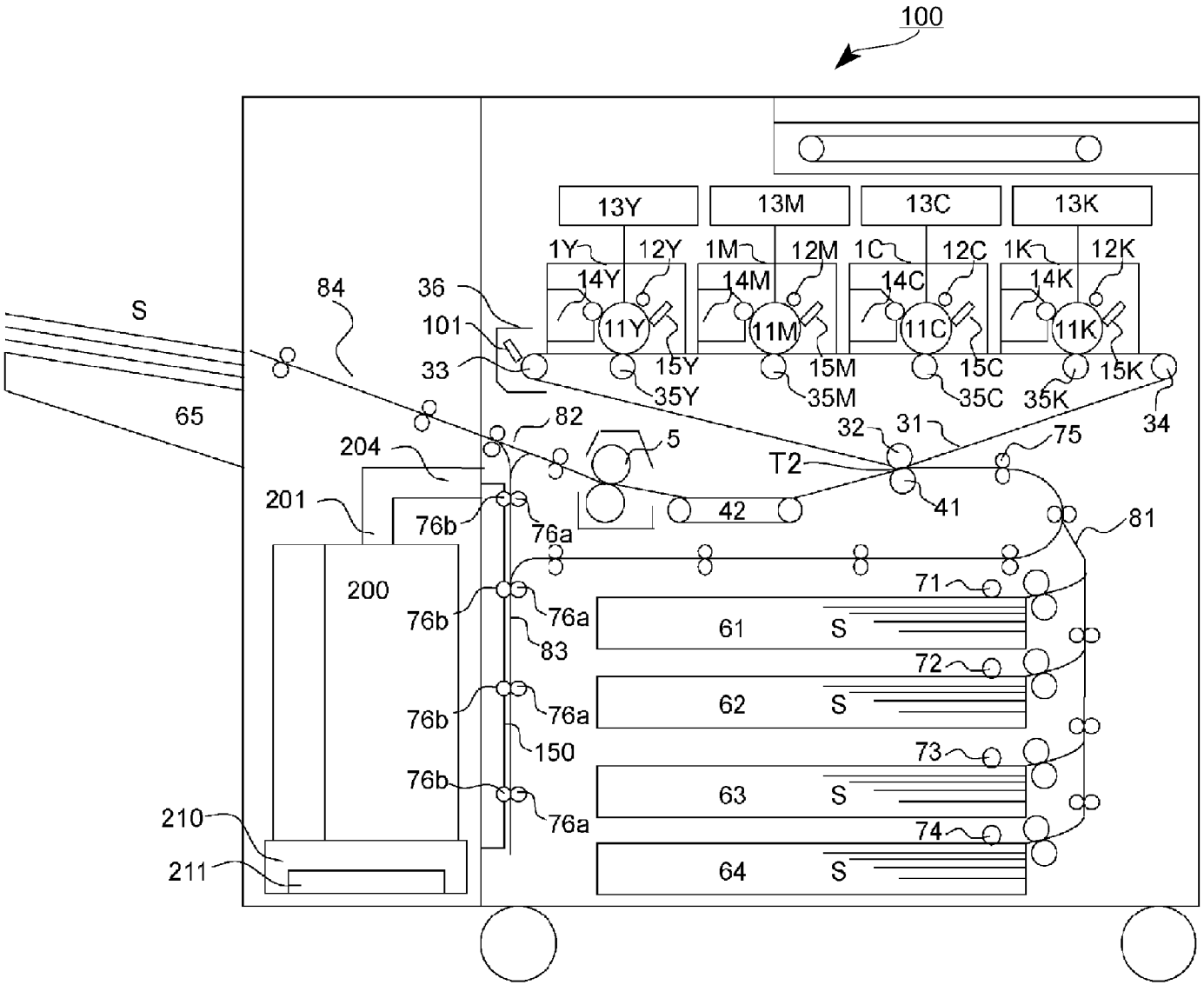
FIG. 1 is a drawing for describing the structure of an image forming apparatus in the first embodiment of the present invention.

Referring to FIG. 1, a recovery container 200 is movable inward or outward of the main assembly of the image forming apparatus to be placed in its preset inside position (installation position) in the main assembly, and also, in its preset outside position (uninstallation position) which makes it possible for the recovery container to be removed from the main assembly. It is in the inside position that the recovery container catches the toner discharged from a discharge pipe 201, which is a part of the image forming section of the apparatus. The preset inside position is such a position that makes the space, through which the recovery container moves when it is moved from its inside position to its outside position, overlap with the space, through which the door for accessing the aforementioned sheet reversing passage moves when it is opened or closed.

A door 150, which is an example of a component which can be opened or closed, is such a door that allows a user of the image forming apparatus to access the interior of the main assembly of the image forming apparatus. More specifically, the door 150 is for allowing a user to access the sheet reversing passage to remove a jammed sheet of recording medium (paper) or the like. Hereafter, this door 150 will be referred to as a "reversal sheet passage access door, or interior access door". The interior access door 150 is provided with sheet conveyance rollers, and is pivotally movable about its pivot, relative to one of the lateral walls of the apparatus main assembly 101*a*, to enable a user to access the interior of the apparatus main assembly. When the interior access door 150 is open, it is impossible for the recovery container 200 to be moved out of the apparatus main assembly 101*a*. When the interior access door 150 remains closed, it is possible for the recovery container 200 to be moved out of the apparatus main assembly.

(Image Forming Apparatus)

FIG. 1 is a drawing for describing the structure of the image forming apparatus. Referring to FIG. 1, the image forming apparatus 100 is a full-color printer of the so-called tandem type, and also, of the so-called intermediary transfer type. It has an intermediary transfer belt 31, and image forming sections 1Y, 1M, 1C and 1K for forming yellow, magenta, cyan, and black toner images, respectively. The four image forming sections are sequentially positioned in parallel along the intermediary transfer belt 31.

In the image forming section 1Y, a yellow tone image is formed on its photosensitive drum 11Y, and is transferred (primary transfer) onto the intermediary transfer belt 31. In the image forming section 1M, a magenta toner image is formed on its photosensitive drum 11M, and is transferred (primary transfer) onto the intermediary transfer belt 31. In the image forming sections 1C and 1M, cyan and black toner images are formed on their photosensitive drums 11C and 11K, respectively, and are transferred (primary transferred) onto the intermediary transfer belt 31.

Sheets S of recording medium (paper) are moved out of cassettes 61-64 one by one. Then, each sheet S is delivered to a pair of registration rollers 75, by which it is kept on standby. Then, it is conveyed by the registration rollers 75 to a transfer section T2, with such timing that it arrives at the transfer section T2 at the same time as the toner images on the intermediary transfer belt 31. In the transfer section T2, the toner images on the intermediary transfer belt 31 are transferred (secondary transfer) onto the sheet S. After the transfer (secondary transfer) of the four toner images, different in color, onto the sheet S, the sheet S is conveyed to a fixing device 5, and is conveyed through the fixing device 5 while being subjected to heat and pressure by the fixing device 5 so that the four toner images on the sheet S are fixed to the sheet S. Then, the sheet S is discharged into a delivery tray 65.

(Image Forming Section)

Referring to FIG. 1, the image forming sections 1Y, 1M, 1C and 1K are practically the same in structure, although they are different in the color of the toner they use; they use yellow, magenta, cyan and black toners, respectively. Hereafter, therefore, only the image forming section 1Y, which forms a yellow toner image, is described. That is, the image forming sections 1M, 1C and 1K are not described in order not to repeat the same description.

The image forming section 1Y has the photosensitive drum 11Y, and various drum processing means, more specifically, a charge roller 12Y, an exposing device 13Y, a developing device 14Y, a transfer roller 35Y, and a drum cleaning device 15Y, which are disposed in the adjacencies of the peripheral surface of the photosensitive drum 11Y. The photosensitive drum 11Y is made up of a substrate, and a photosensitive layer formed on the peripheral surface of the substrate. It rotates leftward of the drawing. The charge roller 12Y uniformly and negatively charges the peripheral surface of the photosensitive drum 11Y to a preset potential level VD (pre-exposure level).

The exposing device 13Y scans the peripheral surface of the photosensitive drum 11Y with a beam of laser light which it outputs while modulating (turning on or off) the beam with the image formation signals obtained by separating the image to be formed into monochromatic images. As a given point of the uniformly charged area of the peripheral surface of the photosensitive drum 11Y is exposed to the beam of laser light, its potential level (VD) reduces to VL (post-exposure level). Consequently, an electrostatic latent image, which reflects the image to be formed, is formed on the peripheral surface of the photosensitive drum 11Y.

The developing device 14Y stirs developer, which is a mixture of toner and carrier, charging thereby the toner and carrier to the negative and positive polarities, respectively. It causes its development sleeve to bear the developer in such a manner that the developer crests to develop the electrostatic latent image on the photosensitive drum 11Y.

The transfer roller 35Y presses on the inward surface of the intermediary transfer belt 31. Thus, a transfer section, which transfers the toner image, is formed between the photosensitive drum 11Y and intermediary transfer belt 31. As positive DC voltage is applied to the transfer roller 35Y, the toner image on the photosensitive drum 11Y is transferred onto the intermediary transfer belt 31.

The intermediary transfer belt 31 is suspended and kept in tension by a combination of a tension roller 33, a driver roller 34, and a secondary transfer inside roller 31. It circularly moves rightward in the drawing, by being driven by the driver roller 34. The secondary transfer roller 41 forms the secondary transfer section T2 by being placed in contact with the intermediary transfer belt 31 backed up by the secondary transfer inside roller 32.

(Developer Recovery Passage)

Figure 2:
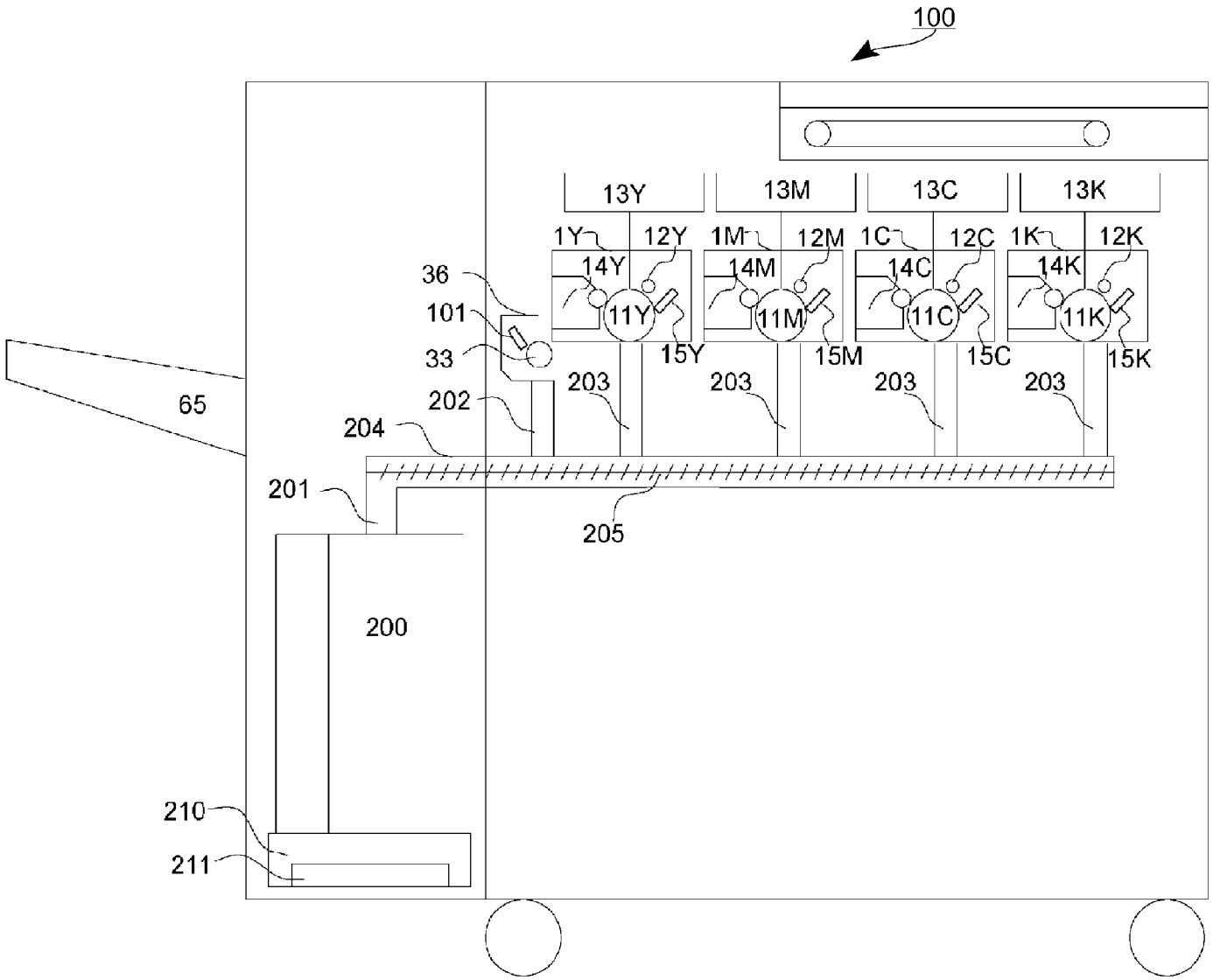
FIG. 2 is a drawing for describing the developer recovery system of the image forming apparatus in the first embodiment.
Figure 3:
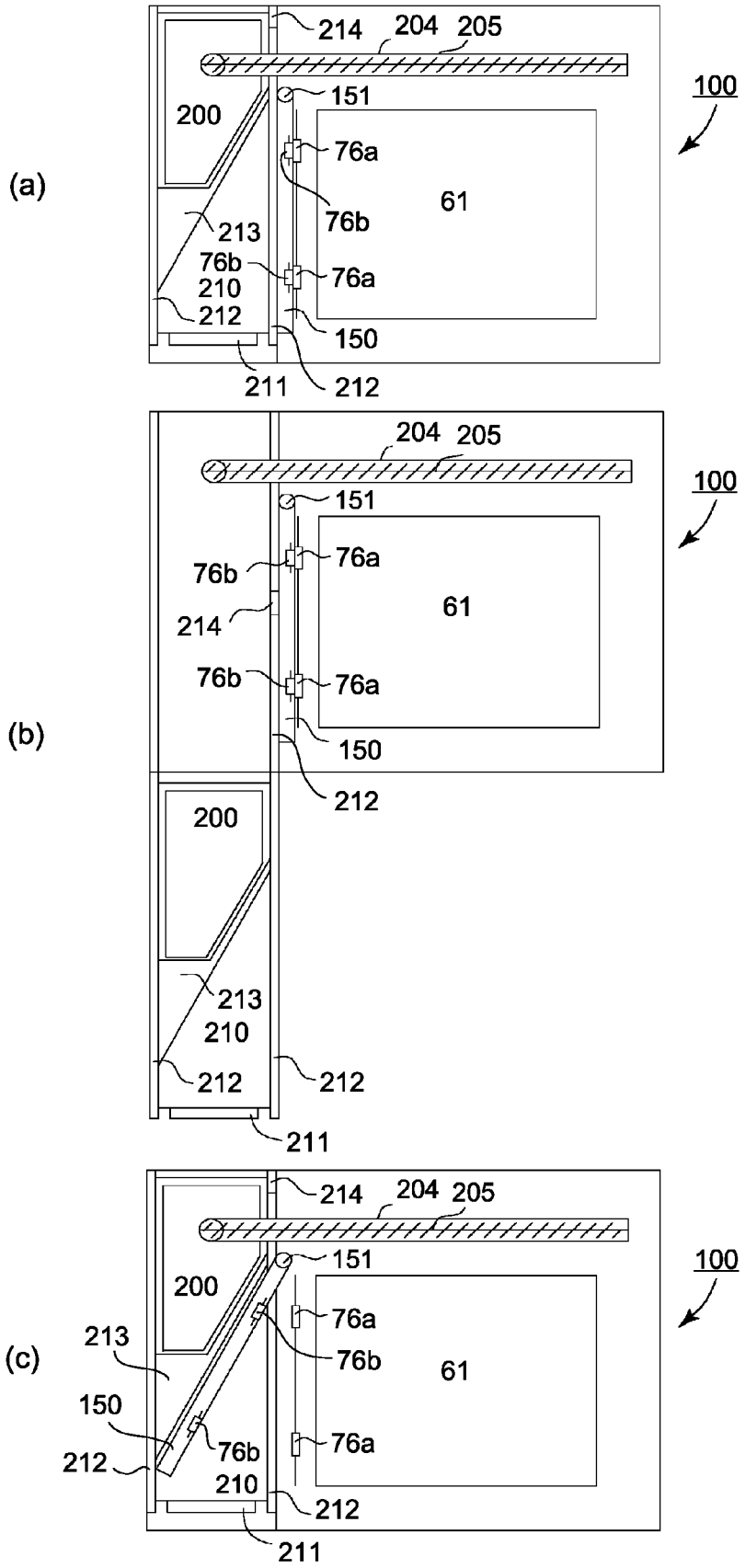
FIG. 3 is a plan view of the developer recovery system of the image forming apparatus in the first embodiment.

FIG. 2 is a drawing for describing the developer recovery system of the image forming apparatus 100. FIG. 3 is a plan view of the developer recovery system of the image forming apparatus 100. FIG. 3(*a*) is related to a period in which an image is being formed, and FIG. 3(*b*) is related to a period in which the recovery container in the apparatus main assembly is replaced. Further, FIG. 3(*c*) is related to a period in which a jammed sheet is removed.

Referring to FIG. 2, as an image is formed by the image forming apparatus 100, a minute amount of toner fails to be transferred, and therefore, remains adhered to the peripheral surface of the photosensitive drum 11Y. This toner, which hereafter will be referred to as transfer residual toner, is scraped away by the cleaning blade of the drum cleaning device 15Y, and is conveyed by an unshown conveyance screw to a vertical pipe 203, which is in the rear side of the casing of the image forming apparatus 100.

As the two-component developer is continuously stirred for a long time in the developing device 14Y, it gradually reduces in chargeability. Therefore, the two-component developer in the developing device 14Y is taken out by a preset amount (at a preset ratio), and recovered. In order to compensate the developing device 14Y for the toner consumed by image formation, the developing device 14Y is replenished with replenishment developer which contains carrier by 10%. During an image forming operation, while the developer in the developing device 14Y is circularly moved in the developing device 14Y, it overflows from the developing device 14Y little by little, more specifically, by an amount (at a ratio) proportional to the amount of the toner consumption, and is conveyed, as deteriorated toner, to the vertical pipe 202.

During an image forming operation, a small amount of toner in the toner image(s) on the intermediary transfer belt 31 fails to be transferred onto a sheet S of recording medium, and remains adhered to the intermediary transfer belt 31. This toner, which hereafter will be referred to also as transfer residual toner, is scraped away by the cleaning blade 101 of the belt cleaning device 36, and is conveyed by an unsown conveyance screw to the vertical pipe 202 which is in the rear portion of the casing of the image forming apparatus 100.

After the transfer residual toner and deteriorated developer are conveyed to the vertical pipes 202 and 203, respectively, they are made to merge into a main recovery pipe 204. Next, referring to FIG. 3(*a*), after having merged into the main recovery pipe 204, the transfer residual toner and deteriorated developer are conveyed by a recovery screw 205 to a discharge pipe 201, fall through the discharge pipe 201, and accumulate in the recovery container 200.

Providing each of the image forming sections 1Y, 1M, 1C and 1K, and the belt cleaning device 36, with its own recovery container makes it difficult and/or complicated to detect whether or not each recovery container is full. Further, it makes complicated the operation for replacing the recovery container in the developing device. Therefore, the transfer residual toner and deteriorated developer are accumulated together in the recovery container 200 as a common recovery container. As the recovery container 200 is filled up with the recovery toner, it is replaced by an empty one. That is, it is a discardable component. In recent years, an image forming apparatus has been substantially improved in image quality and operational speed. Thus, the recovery container 200 has been increased in capacity. From the standpoint of operability, an image forming apparatus is desired to be structured so that a jammed sheet of recording medium, etc., can be removed from the front side of the image forming apparatus, and also, so that the recovery container in the developing device can be replaced from the front side of the image forming apparatus 100.

(Recovery Container)

Figure 4:
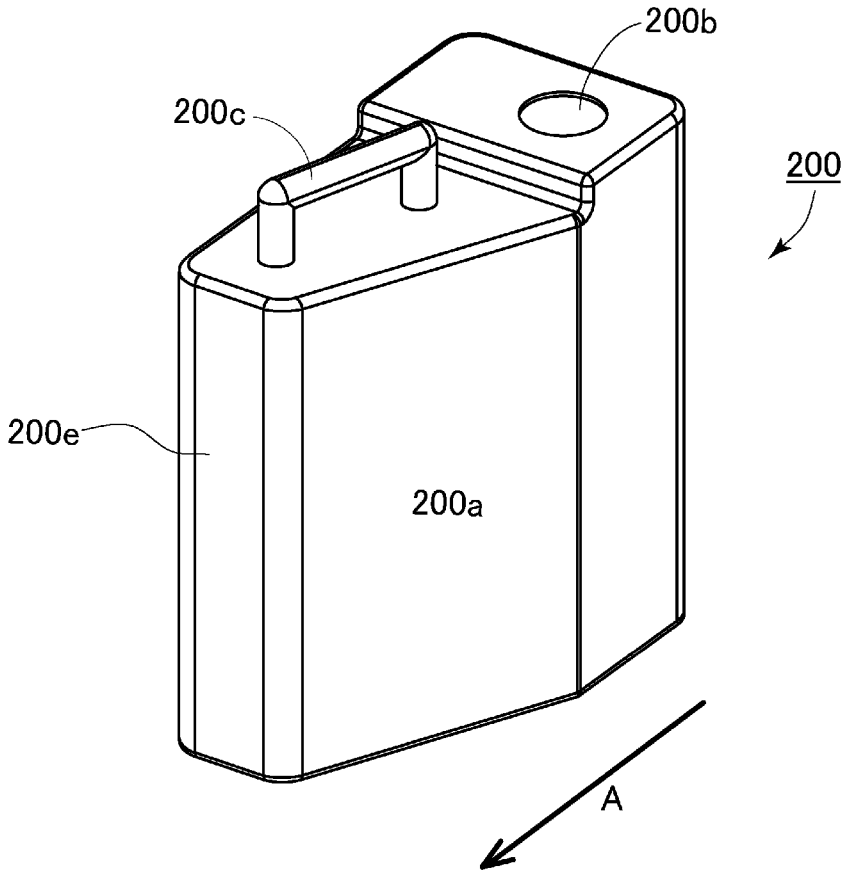
FIG. 4 is a perspective view of the recovery container in the first embodiment.

FIG. 4 is a perspective view of the recovery container 200 in the first embodiment of the present invention. Referring to FIG. 3(*b*), the recovery container 200 is mounted on a recovery container tray 210, in such a manner that it can be moved frontward or rearward in the space in the casing of the image forming apparatus 100, by the recovery container tray 210. The recovery container tray 210 is movable between the first tray position, in which it is entirely in the apparatus main assembly, and the second tray position, in which it allows the recovery container 200 to be placed in the tray 210, or removed from the tray 210.

Next, referring to FIG. 4, the recovery container 200 is 400 mm in height, 70 mm in depth, and 200 mm in width. Its top-rear portion has an opening 200*b*, as an entrance for the recovered toner (developer). Next, referring to FIG. 3(*a*), the opening 200*b* is on the rear side of the sheet passage. Therefore, the recovery container 200 can be placed directly under the main recovery pipe 204. Increasing the distance the waste developer vertically falls through the discharge pipe 201 reduces in angle of rest, the waste developer mass, which the waste developer would form as it accumulates in the recovery container 200.

As long as a mass which the waste developer forms in the recovery container 200 as the waste developer falls into the recovery container 200 is relatively small in angle of rest, the recovery container 200 remains high in actual waste toner capacity, even if a screw, a paddle, etc., are not placed in the recovery container 200 to level the waste developer mass in the recovery container 200. Therefore, the recovery container 200 in this embodiment is smaller in component count, electric power consumption, and simpler in mechanism, than any conventional recovery container, which is equipped with a screw, paddle, etc.

Referring to FIG. 4, the front portion of the recovery container 200 in terms of the direction indicated by an arrow mark A, in which the recovery container 200 is installed or uninstalled, has a angled surface 200*a*, which faces the interior access door 150, and the angle of which is such that when the interior access door 150 is open widest, the angled surface 200*a* is roughly parallel to the interior access door 150. Next, referring to FIG. 3(*b*), the recovery container 200 is shaped so that the angled surface 200*a* becomes roughly parallel to the back surface of the interior access door 150. This structural arrangement makes the space for the movement of the interior access door 150, and the space for the movement of the recovery container 200, overlap with each other. Therefore, it makes it possible to most efficiently use the internal space of the casing of the image forming apparatus.

(Structure for Pulling Recovery Container out of Casing of Image Forming Apparatus)

Figure 5:
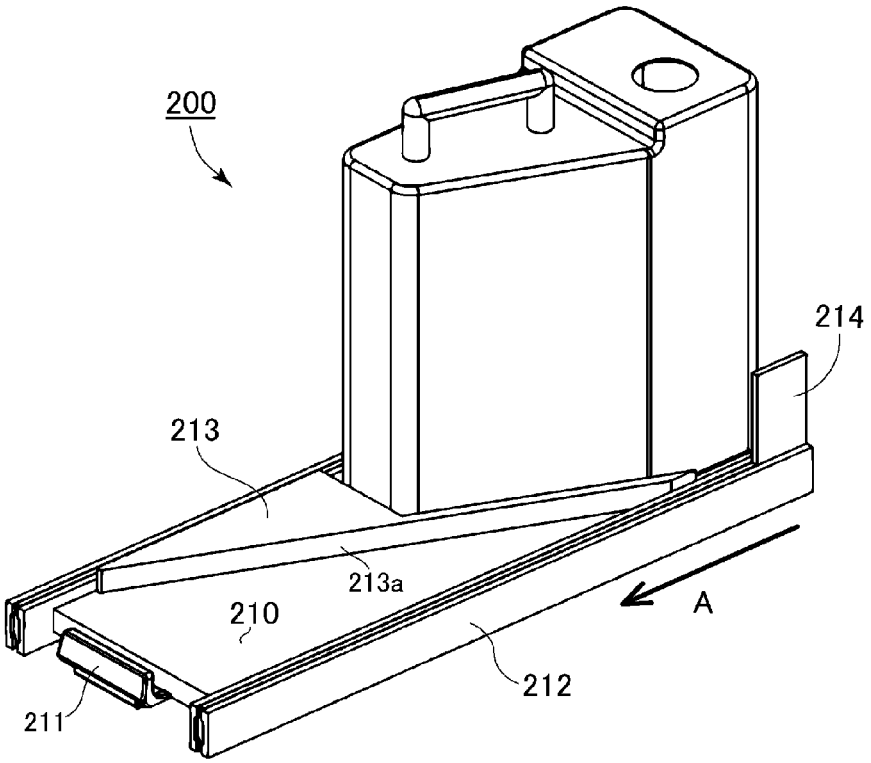
FIG. 5 is a drawing for describing the structure for pulling the recovery container out of the casing of the image forming apparatus.
Figure 5:
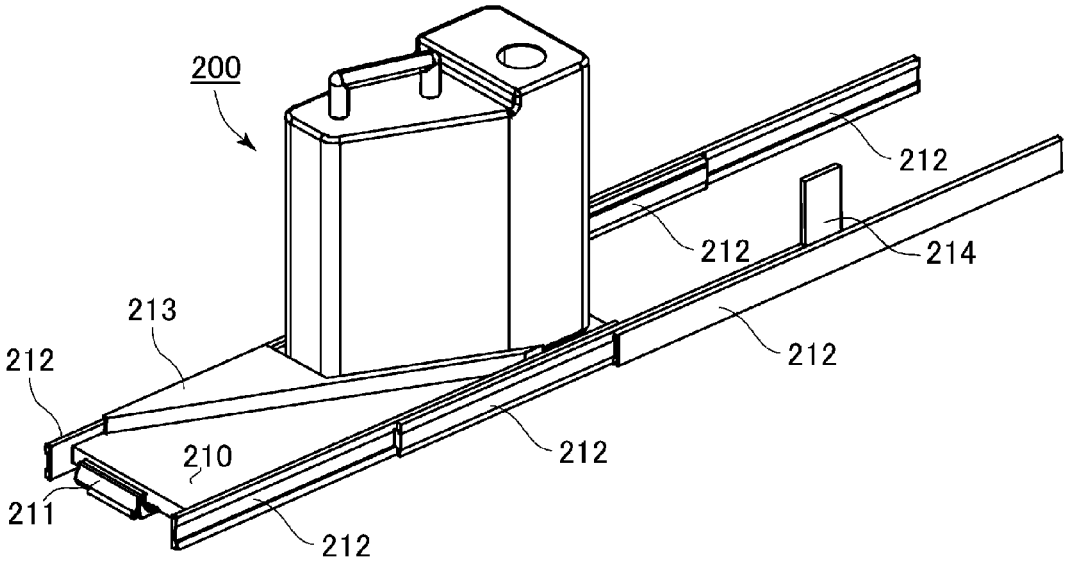

FIG. 5 is a drawing for describing the structure for allowing the recovery container 200 to be pulled out of the casing of the image forming apparatus 100. FIG. 5(*a*) shows the state in which the recovery container 200 and its adjacencies are when the image forming apparatus is forming an image, and FIG. 5(*b*) shows the state in which the recovery container 200 and its adjacencies are when the recovery container 200 is completely out of the casing of the image forming apparatus 100 to be replaced.

Referring to FIG. 5(*a*), the main assembly of the image forming apparatus 100 is provided with a three-piece slide rail. It is the frontmost piece of the slide rail to which the recovery container tray 210 is fixed. The recovery container tray 210 is provided with a tray handle 211, which is fixed to the front side of the tray 210.

Next, referring to FIG. 5(*b*), in order for a user to replace the recovery container 200 in the image forming apparatus 100, the user is to grasp the tray handle 211, and pull the tray handle 211. As the tray handle 211 is pulled, the recovery container tray 210, on which the recovery container 200 is present, moves frontward of the image forming apparatus 100 while being guided by the slide rail 212.

Referring to FIG. 4, the recovery container 200 has a container handle 200*c*, which is on the front side of the recovery container 200. Thus, a user can easily lift the recovery container 200 by grasping the container handle 200*c*, and place an empty (new) recovery container 200 on the recovery container tray 210.

(Jam Solution)

Referring to FIG. 1, the sheet passage of the image forming apparatus 100 has a section which turns a sheet S of recording medium over, and re-feeds the sheet S back into the secondary transfer section T2. This section of the sheet passage is made up of multiple combinations of sheet driving rollers 76*a* and idler rollers 76*b*, which are placed along the interior access door 150. In a case where a paper jam or the like occurs in the above described section of the sheet passage, the jammed sheet S has to be manually removed while the driver rollers 76*a* and idler rollers 76*b* are kept stationary. Thus, the interior access door 150 of the image forming apparatus 100 is to be horizontally and pivotally opened leftward, from the front side of the apparatus main assembly, as shown in FIG. 1, so that the nips which the multiple combinations of driver roller 76*a* and idler roller 76*b* form can be eliminated all at once.

Referring to FIG. 3(*c*), the interior access door 150 can be pivotally moved about a vertical hinge 151, which is on the rear side of the interior access door 150, so that it can be placed in the first position, in which the interior access door 150 makes the idler rollers 76*b* form the nips, or in the second position, in which it does not makes the idler rollers 76*b* form the nips. The interior access door 150 can be pivotally moved about the hinge 151 as much as roughly 25°.

By the way, it is possible to increase the angle by which the interior access door 150 can be pivotally moved, in order to make it easier for a user to see the jammed paper or the like in the apparatus main assembly. However, increasing the angle by which the interior access door 150 can be opened requires the image forming apparatus 100 to be increased in width in terms of the direction parallel to the front panel of the image forming apparatus 100. In this embodiment, therefore, the angle by which the interior access door 150 can be horizontally opened was set to 25°, in order to optimize the relationship between the space for dealing with paper jam or the like, and the apparatus width.

(Structure for Preventing Interference between Interior Access Door and Recovery Container)

Referring to FIG. 5(*a*), the interior access door 150 is precisely positioned relative to the recovery container tray 210 by being fitted into the recess, with which the contact preventing portion 213 of the recovery container tray 210 is provided. The contact preventing portion 213 is provided with an angled surface 213*a*, which is positioned so that when the interior access door 150 is in the aforementioned recess, the angled surface 213*a* will be slightly outwardly offset from the recovery container 200. The contact preventing portion 213 prevents the interior access door 150 from making direct contact with the recovery container 200.

Even if the interior access door 150 happens to be open, as the recovery container tray 210 is moved frontward of the apparatus main assembly, the angled surface 213*a* is made to push the interior access door 150, causing thereby the interior access door 150 to close. Therefore, the interior access door 150 is prevented from coming into contact (colliding with) the recovery container 200. That is, the angled surface 213*a* is angled in such a direction that as the recovery container tray 210 is moved frontward of the image forming apparatus 100, the angled surface 213*a* presses the interior access door 150 in the direction to close the interior access door 150. In other words, the angled surface 213*a* is made to close the interior access door 150 by the outward movement of the recovery container tray 210. Therefore, even if the interior access door 150 is open, it has no effect upon the operation for replacing the recovery container 200. That is, this structural arrangement can improve the image forming apparatus 100 in operability in terms of the operation for replacing the recovery container 200.

Referring to FIG. 3(*c*), if it is necessary for a jammed sheet of paper or the like to be removed, the interior access door 150 is to be opened to separate the idler rollers 76*b* from the driver rollers 76*a*. As the interior access door 150 is opened, the contact preventing portion 213 plays the role of a stopper for preventing the interior access door 150 from colliding with the recovery container 200. The contact preventing portion 213 surrounds the entirety of the bottom edge portion of the recovery container 200. Therefore, even when the interior access door 150 and/or recovery container tray 210 is somewhere in their range of movement, it does not occur that the interior access door 150 and recovery container 200 interfere with each other.

If an attempt is made to pull the recovery container tray 210 out of the apparatus main assembly 101*a* when the interior access door 150 is open, the contact preventing portion 213 presses the interior access door 150 in the direction to close the interior access door 150. Therefore, it is possible to prevent the problem that when the recovery container tray 210 is pulled out of the apparatus main assembly 101*a*, or pushed back into the apparatus main assembly, or when the interior access door 150 is opened or closed, the recovery container 200 is felled upset, and/or the contents of the recovery container 200 are spilled, by the collision between the interior access door 150 and recovery container 200.

Referring to FIG. 5(*a*), a component 214 for regulating the movement of the interior access door 15 is fixed to the rear end of the mid section of the three-piece slide rail 212. The door movement regulating component 214 is a component for preventing the interior access door 150 from being opened when the recovery container tray 210 has been frontwardly moved out of the apparatus main assembly, far enough for the angled surface 213*a* to be prevented from holding the interior access door 150. That is, the door movement regulating component 214 prevents the problem that when the interior access door 150 is open widest, the recovery container tray 210, on which the recovery container 200 is present, is pushed into the apparatus main assembly, and collides with the interior access door 150.

Further, the door movement regulating component 214 prevents the problem that the interior access door 150 opens when the recovery container tray 210 is in the second tray position. While the recovery container tray 210 is out of the apparatus main assembly, the interior access door 150 does not open. Therefore, it can be avoided that the recovery container tray 210 is pushed into the apparatus main assembly while the interior access door 150 is open. Further, if the recovery container tray 210 happens to be pulled outward of the apparatus main assembly 101*a* while the interior access door 150 is open, the interior access door 150 is automatically closed by the outward movement of the recovery container tray 210.

Effects of Embodiment 1

In the first embodiment, the image forming apparatus 100 is structured so that the space through which the recovery container 200 moves while being guided by the slide rail 212 overlaps with the space through which the interior access door 150 pivotally moves about the hinge 151. Therefore, its main assembly can be smaller in footprint and volume than that of an image forming apparatus structured so that the two spaces do not overlap with each other.

In the first embodiment, the recovery container 200 is made up of the first section which will be on the rear side of the interior access door 150 when the recovery container 200 is in its preset inside position (installation position), and the interior access door 150 is open, and the second section which will be on the front side of the first section and extends to the immediate adjacencies of the interior access door 150 when the interior access door 150 is open. Therefore, the recovery container 200 is greater in capacity, being therefore longer in replacement interval than a conventional recovery container.

In the first embodiment, the slide rail 212, which is an example of a supporting mechanism, supports the recovery container 200 in such a manner that the recovery container 200 can be moved to the preset outside position (uninstallation position) while being supported by the slide rail 212. Thus, it is unnecessary for a user to bear the weight of the recovery container 200 while the user is moving the recovery container 200 inward or outward of the apparatus main assembly.

In the first embodiment, the contact preventing portion 213 and door movement regulating component 214, which are examples of a regulating member, are attached to the slide rail 212. Thus, as the recovery container 200 is moved to the preset outside position (uninstallation position), the contact preventing portion 213 and door movement regulating component 214 are moved by the movement of the slide rail 212 to their position in which they regulate the opening movement of the interior access door 150. Therefore, it does not occur that the interior access door 150 and recovery container 200 are made to collide with each other, even if a user absent-mindedly opens the interior access door 150.

In the first embodiment, the recovery container 200 is provided with the opening, which is a part of its top wall, and can be connected to, or disconnected from, the discharge pipe 201. Its vertical dimension is greater than its horizontal dimension. Therefore, it can be placed in a narrow space, and yet, can be substantial in capacity.

In the first embodiment, it is the top wall of the recovery container 200 that is provided with the opening. Further, the opening is on the rear side of the sheet conveyance passage. Therefore, the opening can be connected to, or disconnected from, the discharge pipe 201, in the direction perpendicular to the recovered toner conveying passage. That is, this embodiment can make the recovery container 200 simpler in structure, and low in cost.

In the first embodiment, the recovery container 200 is made up of the first section, which is similar to a conventional recovery container, and the second section which is provided with the angled surface 200*a* and is positioned so that when the recovery container 200 is in the preset inside position (installation position) and the interior access door 150 is open, the second section extends frontward to the immediate adjacencies of the interior access door 150, with the angled surface 200*a* being roughly parallel to the interior access door 150. Therefore, the recovery container 200 in this embodiment is substantially greater in capacity than a conventional recovery container. Further, being provided with the angled surface 200*a*, the recovery container 200 does not interfere with the opening or closing of the interior access door 150, nor affect the maximum angle by which the interior access door 150 can be opened, even though it has been elongated in the depth direction of the apparatus main assembly to be increased in capacity.

In the first embodiment, the image forming apparatus 100 is structured so that the space through which the recovery container 200 moves overlaps with the space through which the interior access door 150 is opened or closed. Therefore, the recovery container 200 in this embodiment is substantially greater in capacity than a conventional recovery container, even though it is no greater in size than a conventional recovery container. That is, this embodiment can increase the recovery container 200 in capacity without requiring the apparatus main assembly to be increased in overall size. In other words, not only can this embodiment increase the recovery container 200 in capacity, but also, can improve the image forming apparatus 100 in terms of the efficiency with which a jammed paper or the like can be removed.

In the first embodiment, the recovery container 200 is moved out of the apparatus main assembly, or moved into the apparatus main assembly, together with the recovery container tray 210. Therefore, the image forming apparatus 100 is superior to a conventional image forming apparatus, in terms of ease and efficiency with which the recovery container 200 in the apparatus main assembly can be replaced.

In the first embodiment, the contact preventing portion 213 surrounds the entirety of the bottom edge portion of the recovery container 200. Therefore, the recovery container 200 is safe even if it is subjected to a force which comes from an unexpected direction.

This embodiment makes it unnecessary to employ such a structure that when it is necessary to remove a jammed sheet of paper or the like, it is required for the conveyance guide to be frontwardly pulled out of the apparatus main assembly, the conveyance guide to be opened or closed in the opposite direction from the recovery container 200, and/or the recovery container 200 to be installed or uninstalled. Therefore, it does not require an image forming apparatus to be increased in size and/or complicated in structure, and/or does not complicate the process of removing a jammed sheet of paper or the like.

In the first embodiment, the recovery container 200 is allowed to be taller, being therefore naturally higher in the amount by (ratio at) which it is filled with developer. Therefore, it is unnecessary for the recovery container 200 to be equipped with an internal screw or the like in order for the recovery container 200 to be increased in fill factor. Therefore, it does not invite the cost increase attributable to structural complication and increase in component count.

Embodiment 2

Figure 6:
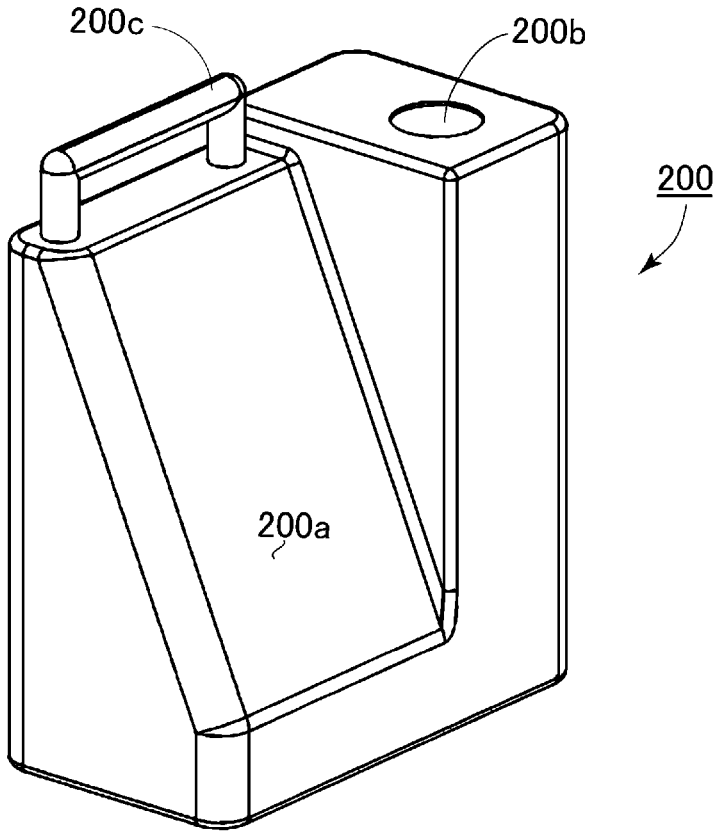
FIG. 6 is a perspective view of the recovery container in the second embodiment of the present invention.
Figure 7:
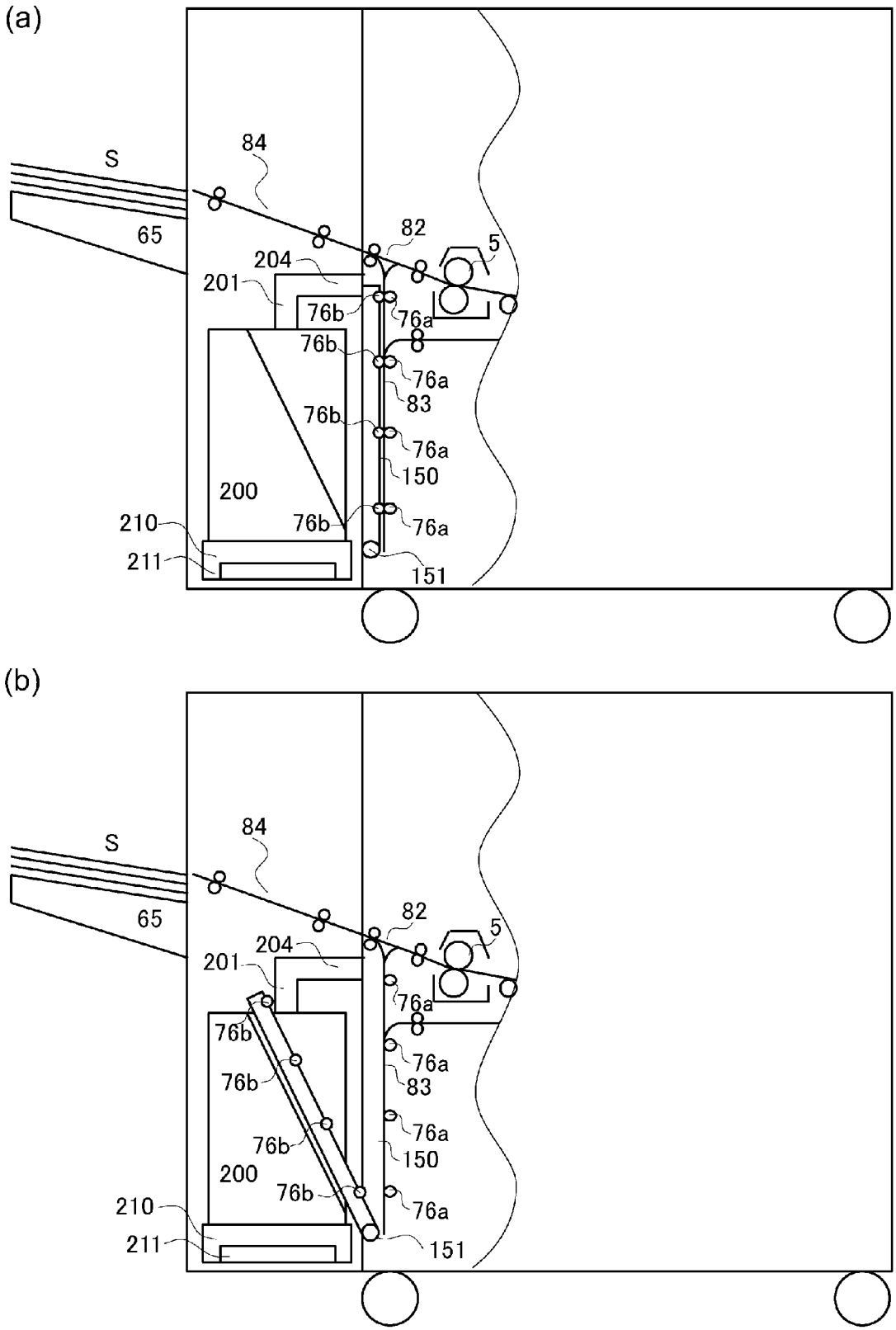
FIG. 7 is a front view of the developer recovery system of the image forming apparatus in the second embodiment.

FIG. 6 is a perspective view of the recovery container in the second embodiment of the present invention. FIG. 7 is a front view of the developer recovery system of the image forming apparatus. FIG. 7(*a*) is related to a period in which an image is being formed, and FIG. 7(*b*) is related to a period in which the apparatus is ready for removal of a jammed sheet of paper or the like.

Referring to FIG. 3(*c*), in the first embodiment, the interior access door 150 was horizontally and pivotally moved about the vertical hinge 151 to be opened or closed. In comparison, in the second embodiment, the interior access door 150 is vertically and pivotally moved about a horizontal hinge 151 to be opened or closed. Otherwise, the second embodiment is the same as the first one. Thus, the structural components, their parts, etc., in the second embodiment, which are the same as the counterparts in the first embodiment, are given the same referential codes as those given to the counterparts, in order not to repeat the same descriptions.

Referring to FIG. 6, the recovery container 200 has an opening 200*b* and an angled surface 200*a*. The opening is a part of the top wall of the recovery container 200. The angled surface 200*a* is a part of the front section of the recovery container 200. It is angled in such a direction that it makes the top portion of the front section portion of the recovery container 200 narrower than the bottom portion of the front portion of the recovery container 200.

Referring to FIG. 7(*a*), during the insertion or removal of the recovery container 200, the interior access door 150 is kept closed, maintaining thereby the nips for sheet conveyance. Further, the interior access door 150 remains retracted from the space through which the recovery container 200 is moved. Therefore, the recovery container 200 can be frontwardly pulled out of the apparatus main assembly, together with the recovery container tray 210, without any interference.

Referring to FIG. 7(*b*), when a jammed sheet of paper or the like needs to be removed, the interior access door 150 is to be pivotally moved outward roughly 25° about the hinge 151. That is, during the removal of a jammed sheet of paper or the like, the interior access door 150 is in the space for the movement of the recovery container 200.

However, the recovery container 200 is provided with the angled surface 200*a*, which is angled so that it will be outside the space for the movement of the interior access door 150. Therefore, it does not occur that the recovery container 200 interferes with the pivotal movement of the interior access door 150. That is, a user is free to open the interior access door 150 to create the space for the removal of the jammed sheet of paper or the like, in order to make it easier to remove the jammed sheet of paper or the like.

The recovery container 200 is greater in capacity than a conventional recovery container, because it has been increased in depth by the addition of its second section (front section) which has the angled surface 200*a*, being therefore out of the space for the movement of the interior access door 150. The space for the movement of the recovery container 200 overlaps with the space through which the interior access door 150 moves when it is opened or closed. However, it does not occur that the recovery container 200 and interior access door 150 contact with each other during an image forming operation in which a jam might occur.

The second embodiment shows that even an image forming apparatus, the interior access door 150 of which is hinged along its bottom edge, can be reduced in cost by the simplification of its recovery container 200.

Miscellanies

The present invention is applicable to image forming apparatuses which are partially or entirely different in structure from those in the preceding embodiment, as long as they are structured so that at least a part of the space through which their movable component moves overlaps with the space through which their recovery container moves.

In other words, the present invention is also applicable to a sheet conveyance passage, other than the above described sheet reversing passage, which is made up of two subassemblies separable at the sheet conveyance nips, a fixing device, an exposing device, an intermediary transfer unit, and the like. The application of the present invention is not limited to those in the above-described embodiments. That is, the present invention is applicable regardless of whether an image forming apparatus is of the drum type or tandem type, whether an image forming apparatus uses single-component developer or two-component developer, and whether an image forming apparatus is of the intermediary transfer type or direct transfer type. Further, the present invention is applicable regardless of image bearing member count, method for charging an image bearing member, method for forming an electrostatic image, developing method, transfer method, fixing method, etc. In the foregoing, only the portions of the image forming apparatus, which are primarily related to the formation and transfer of a toner image, were described. However, the present invention is also applicable to various image forming apparatuses other than those in the preceding embodiments, for example, a printer other than those in the preceding embodiment, a copying machine, a facsimile machine, a multifunction machine, that is, a combination of one of the image forming apparatuses in the preceding embodiment, and additional devices, equipments, casing, etc.

The image forming apparatus in accordance with the present invention is structured so that the space through which a "door" moves in the apparatus main assembly overlaps with the space through which the recovery container moves in the apparatus main assembly. Therefore, it is smaller in the size of its main assembly than an image forming apparatus structured so that above-described two spaces do not overlap with each other. That is, the present invention can provide an image forming apparatus with an internal passage through which a recovery container can be pulled out of the apparatus main assembly, without increasing the apparatus main assembly in size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 193728/2013 filed Sep. 19, 2013, which is hereby incorporated by reference.

What is claimed is:

1. An image forming apparatus comprising:

an image forming station configured to form a toner image;

a toner collection container configured to collect toner discharged from said image forming station;

a supporting unit configured to support said toner collection container and to be movable between a collecting position for collecting the toner discharged from said image forming station while said image forming station forms the toner image and a mounting and dismounting position at which said toner collection container is mountable and dismountable relative to said image forming apparatus;

an openable member rotatably movable between a closing position and an opening position, wherein a rotatable axis of said openable member extends in a vertical direction and is disposed upstream of said openable member with respect to a movement direction of said supporting unit from the collecting position to the mounting and dismounting position; and a restricting portion provided on said supporting unit and being configured to prevent contact between said toner collection container and said openable member, wherein a part of a movement path of said openable member, along which said openable member moves between the closing position and the opening position, and a part of a movement path of said toner collection container, along which said toner collection container moves with said supporting unit between the collecting position and the mounting and dismounting position, are overlapped with each other, wherein said toner collection container includes a portion overlapping said openable member as viewed in a horizontal direction perpendicular to the movement direction of said supporting unit when said toner collection container is mounted on said supporting unit, and said supporting unit is in the collecting position, wherein the overlapping portion of said toner collection container includes an inclined surface inclining away from said openable member toward a downstream side with respect to the movement direction of said supporting unit, wherein said restricting portion provided on said supporting unit extends along the inclined surface of said toner collection container, wherein a side surface of said restricting portion includes a first portion overlapping said toner collection container and a second portion not overlapping said toner collection container, as viewed in the horizontal direction perpendicular to the movement direction of said supporting unit, when said toner collection container is mounted on said supporting unit, and said supporting unit is in the collecting position, and wherein the second portion is disposed such that when said openable member is in the opening position, said restricting portion is opposed substantially along an entirety of said openable member in a widthwise direction of said openable member, and the second portion is disposed extending along the first portion.

2. The apparatus according to claim 1, wherein said openable member is provided in a side opposed to a side surface of said image forming apparatus, and said toner collection container is provided in the rear side of said image forming apparatus.

3. The apparatus according to claim 1, further comprising a recording material feeding passage for discharging recording material, having the image formed by said image forming station thereon, out of said image forming apparatus, said recording material feeding passage being disposed above said supporting unit.

4. The apparatus according to claim 1, wherein said toner collection container is provided in a top side thereof with an opening detachably connected with said image forming station, and has a vertical length greater than a maximum horizontal length.

5. The apparatus according to claim 1, wherein said openable member includes a rotation door for jam clearance, and is provided with a sheet feeding roller.

6. The apparatus according to claim 1, wherein said restricting portion is provided with a guiding portion for guiding said openable member placed in the opening position toward said closing position with movement of said supporting unit.

* * * * *